US005797831A

United States Patent [19]

Roberts et al.

[11] Patent Number: 5,797,831

[45] Date of Patent: Aug. 25, 1998

[54] VACUUM HOLD DOWN FOLDER/GLUERS AND PROCESS

[75] Inventors: John T. Roberts, Clover, S.C.; Jimmy R. Bridges, Charlotte, N.C.

[73] Assignee: Roverts Systems, Inc., Charlotte, N.C.

[21] Appl. No.: 519,248

[22] Filed: Aug. 25, 1995

[51] Int. Cl.[6] ..... B31F 1/08

[52] U.S. Cl. ..... 493/438; 493/179; 493/182; 493/418; 493/450

[58] Field of Search ..... 493/3, 29, 177–180, 493/181–183, 248, 401, 405, 416, 418, 436, 438, 439, 440, 446–448, 450, 455, 122; 198/689, 817, 575, 576, 813, 814, 816, 861.1, 493

[56] References Cited

U.S. PATENT DOCUMENTS

| | | | |
|---|---|---|---|
| 2,598,809 | 6/1952 | Liebl | 493/177 |
| 2,866,393 | 12/1958 | Kemp | 493/416 |
| 3,107,588 | 10/1963 | Lobdell et al. | 493/183 |
| 3,138,076 | 6/1964 | Lobdell et al. | 493/183 |
| 3,580,144 | 5/1971 | Renard | 493/183 |
| 3,614,914 | 10/1971 | Troll . | |
| 3,648,573 | 3/1972 | Lefebvre et al. . | |
| 3,656,416 | 4/1972 | Baum | 493/438 |
| 3,706,370 | 12/1972 | Bonafino et al. | 198/575 |
| 3,797,371 | 3/1974 | Randle | 493/438 |
| 3,820,650 | 6/1974 | Garvey | 198/861.1 |
| 3,944,054 | 3/1976 | Ensinger | 198/896.1 |
| 4,007,827 | 2/1977 | Mattos | 198/861.1 |
| 4,060,227 | 11/1977 | Landgraf et al. | 493/418 |
| 4,187,769 | 2/1980 | Bullock | 493/438 |
| 4,254,692 | 3/1981 | Sardella | 493/179 |
| 4,366,900 | 1/1983 | Johansson | 198/817 |
| 4,396,110 | 8/1983 | Christensen | 198/576 |
| 4,514,181 | 4/1985 | Hughes . | |
| 4,517,058 | 5/1985 | Hodges et al. . | |
| 4,598,819 | 7/1986 | Siegwart | 198/861.1 |
| 4,614,512 | 9/1986 | Capdeboscq | 493/179 |
| 4,619,637 | 10/1986 | Jones . | |
| 4,642,085 | 2/1987 | Helm . | |
| 4,645,069 | 2/1987 | Sjogren | 198/689.1 |
| 4,672,792 | 6/1987 | Wallin | 198/689.1 |
| 4,698,950 | 10/1987 | Marchetti | 493/438 |
| 4,701,156 | 10/1987 | Larsonneur | 493/438 |
| 4,730,526 | 3/1988 | Pearl et al. | 198/689.1 |
| 4,840,268 | 6/1989 | Zemek | 198/817 |
| 4,842,125 | 6/1989 | Besemann | 198/493 |
| 4,881,633 | 11/1989 | Cailey et al. | 198/816 |
| 4,921,240 | 5/1990 | Watson | 271/245 |
| 4,951,809 | 8/1990 | Boothe et al. | 198/861.1 |
| 4,962,844 | 10/1990 | Francioni | 198/575 |
| 5,016,812 | 5/1991 | Pedigrew . | |
| 5,035,683 | 7/1991 | Takeda et al. | 493/178 |
| 5,051,145 | 9/1991 | Len Hardt | 198/689.1 |
| 5,058,727 | 10/1991 | Jahns et al. | 198/575 |
| 5,094,658 | 3/1992 | Smithe et al. | 493/438 |
| 5,151,075 | 9/1992 | Beaulleu et al. | 493/178 |
| 5,174,435 | 12/1992 | Dorner et al. | 198/813 |
| 5,186,308 | 2/1993 | Munro | 198/576 |
| 5,228,558 | 7/1993 | Hall | 198/575 |
| 5,230,686 | 7/1993 | McAdam, II et al. | 493/179 |
| 5,234,097 | 8/1993 | Okuyama | 198/689.1 |
| 5,311,979 | 5/1994 | Risley et al. | 198/493 |
| 5,416,992 | 5/1995 | Ueda et al. | 198/689.1 |
| 5,421,451 | 6/1995 | Easton | 198/861.1 |

*Primary Examiner*—Joseph J. Hail, III
*Assistant Examiner*—Darren Ark
*Attorney, Agent, or Firm*—Hardaway Law Firm P

[57] ABSTRACT

A vastly improved folder/gluer is disclosed. This folder/gluer: is much more reliable, produces better folds, runs faster, and can be modified much easier, than prior art folder/gluers. These features are achieved by using a vacuum conveyor with overhead folding elements. Furthermore, the top of the article to be folded is never touched by another conveyor.

12 Claims, 8 Drawing Sheets

VACUUM HOLD DOWN FOLDER/GLUERS AND PROCESS

DESCRIPTION OF THE PRIOR ART

FIG. 1 shows a conventional flat blank B, which can be folded into a box. As blank B is fed in direction F, folds 1 and 2 are first made in that order, with folds 3 and 3 simultaneously made after folds 1 and 2. Glue G is placed on lip L1, which is then placed under lip L2, finishing the box, except for the folding and closing of the top and bottom flaps, which are not concerns of this invention.

FIGS. 2A and 2B shows a simplified version of a prior art feeding device 900 used to feed blanks B in direction F while the various folds described above are made (the folding mechanism is not shown). Device 900 comprises upper and lower conveyors, between which blank B is fed, sandwiched between belts 901, 901'. Belts 901, 901' are driven by drive rollers 902, 902' around idler rollers 904, 904'. Drive rollers 902, 902' are driven by drive shafts 903, 903' connected to not-shown drive motors. Pressure roller assemblies 910, 910' (of which only a few are shown) maintain the sandwiched arrangement of blank B. Roller assemblies 910 comprise rollers 911 mounted via pivot arms 912 to a stationary surface. Edge guides 914 prevent lateral movement of belt 901 with respect to roller 911. A typical machine such as this has hundreds of roller assemblies 910. U.S. Pat. No. 5,151,075 to Beaulleu et al. shows a typical example of device 900 and visually indicates just how complex prior art carton forming devices are in relation to the instant invention.

Device 900 is overly complicated, difficult to use, unreliable, and does not allow for the construction of the best possible boxes. Device 900 is overly complicated because it has so many components in specific arrangements that it is not subject to modular usage with blanks B of various sizes. Device 900 is difficult to use because: (1) belts 901, 901' wear quickly due to the vast number of idler rollers 904, 904' and rollers 911, 911' in contact with belts 901, 901', and (2) belt replacement is difficult and can take up to a day and a half because replacement belts have to be threaded over all the previously mentioned rollers and drive shafts 903, 903' must be removed. Device 900 is unreliable because it has so many moving parts that will and do fail during high speed usage of the device. For example, while device 900 may be capable of high-speed feeding, it can only maintain the high speed for a short period of time. After this short period of time, the various springs, rollers, bearings, and belts will fail. Finally, device 900 does not allow for constructing the best possible boxes because it does not allow for a 180° fold to be made at fold 2 of FIG. 1, or in other instances where 180° folds are needed. The 180° fold, after unfolded, results in a deeper crease in blank B that allows for very easy unfolding of the flattened and glued box at a downstream filling machine. Furthermore, 180° folds provide for superior stacking of folded boxes since each flattened box will be of a generally constant thickness. Thus, a stack of flattened boxes will not tend to lean to a side or tip over. Device 900 does not allow for 180° folds because the upper conveyor 901, along with all the not shown folding mechanisms associated with device 900, get in the way (FIG. 2B).

Thus, there is room for improvement within the art.

OBJECTS OF THE INVENTION

It is an object of the invention to provide an improved conveyor unit that can be used to feed a box blank through folding, gluing, and compression stations.

It is a further object of the invention to provide an improved conveyor unit that has the potential to make 180° folds in the box blank.

It is yet a further object of the invention to provide an improved conveyor system that allows for reduced belt wear and easier belt replacement.

It is still yet a further object of the invention to provide an improved conveyor system that allows for modular usage to feed blanks of varying sizes.

It is still yet a further object of the invention to provide an improved conveyor unit that represents a drastic reduction in moving parts, wear, and need for adjustment, from prior art conveyors.

It is still yet a further object of the invention to provide a folder/gluer lacking the complex overhead mechanical movements found in prior art folder/gluers.

It is still yet a further object of the invention to provide a reliable article separator for use with the folder/gluer according to the invention.

These and other objects of the invention are achieved by a vacuum hold down device for a folding mechanism for pre-scored paper-board articles, comprising: a substantially enclosed conveyor housing having a vacuum inlet, side plates, a conveyor table having vacuum holes along its length, and defining a vacuum chamber therein; at least one conveyor belt in between the side plates and spanning the conveyor table such that the at least one conveyor belt cannot flex; a drive mechanism associated with the conveyor belt for driving the at least one conveyor belt; a vacuum source in fluid communication with the vacuum inlet; whereby when the vacuum source is activated, a vacuum is created in the vacuum chamber and in the area of the vacuum holes, thereby causing the pre-scored paper-board articles to adhere to the belt and against the conveyor table; and folding elements spaced above the conveyor module for folding and forming a flat pre-scored paper-board article into a container.

DETAILED DESCRIPTION OF THE DRAWINGS

In accordance with this invention, it has been found that a conveyor module for a folder/gluer can be provided that allows for easier belt replacement, reduced belt wear, improved folding of the conveyed blank, and various other beneficial results.

Figure 3A:
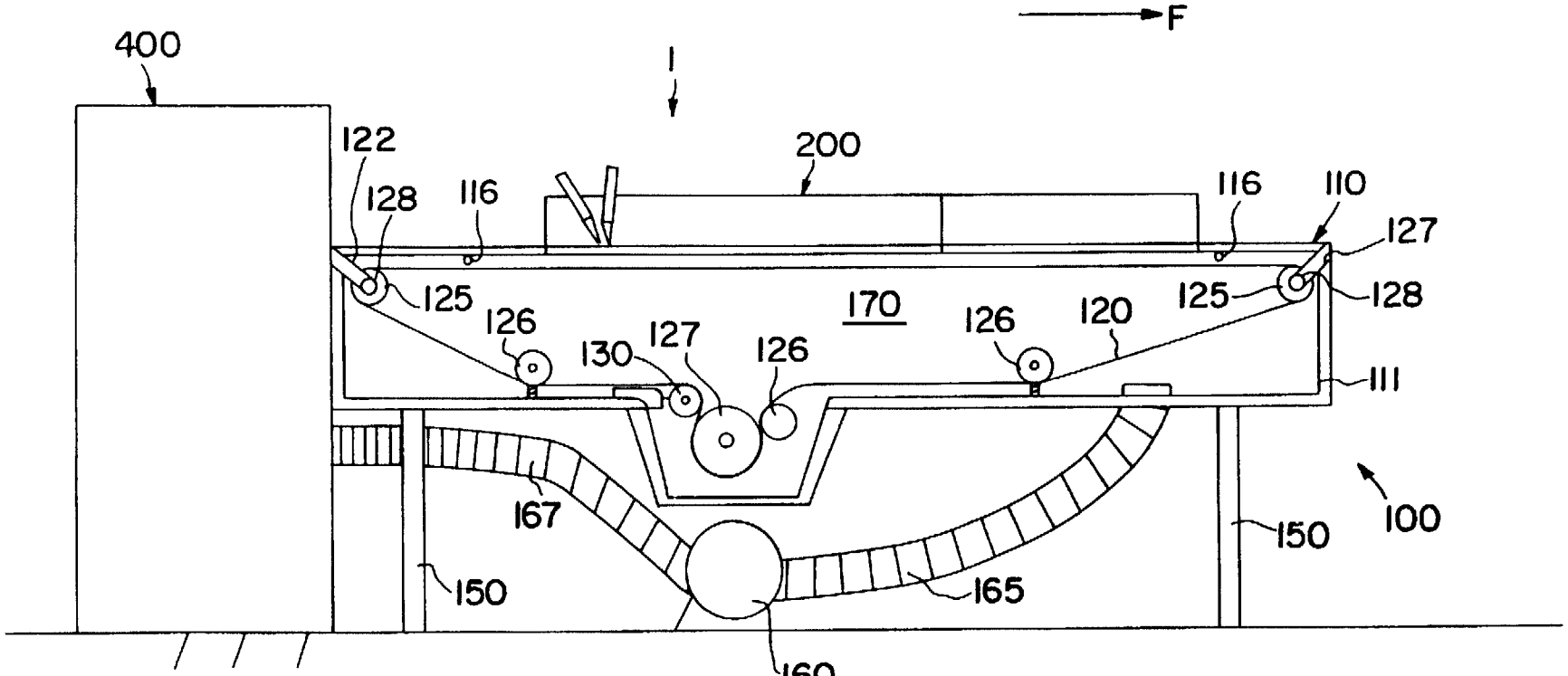
FIG. 3A is an elevational view, in partial cutaway, showing a first embodiment of a conveyor module according to the invention.
Figure 3B:
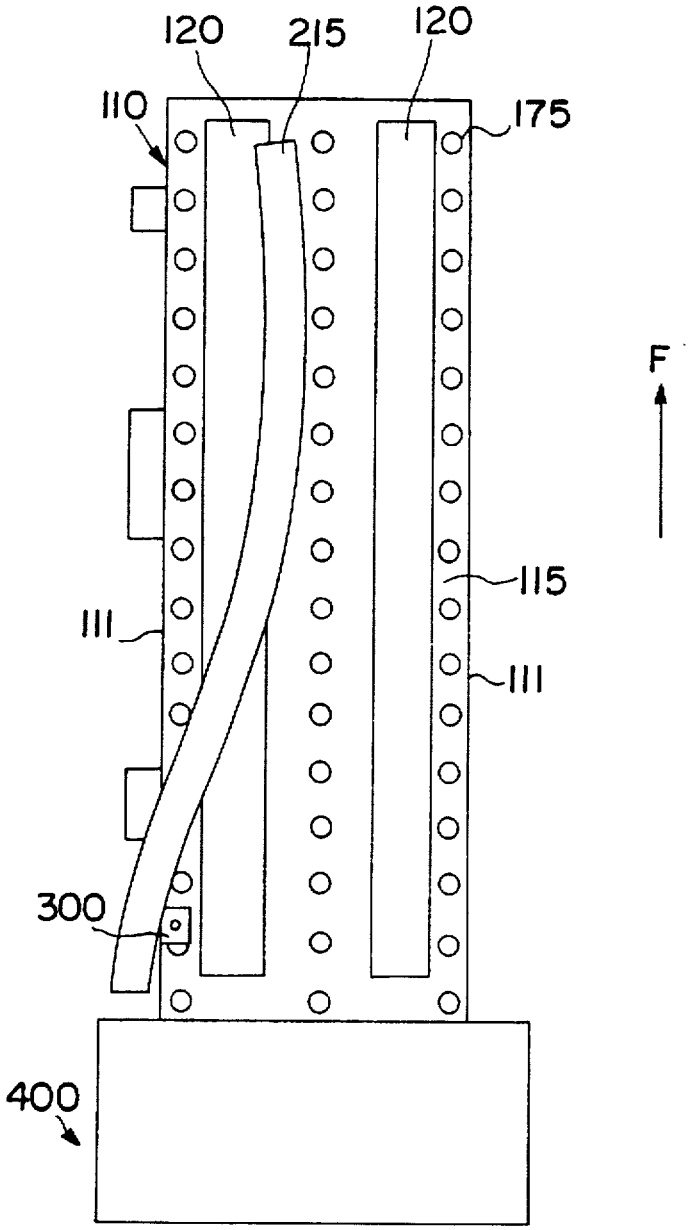
FIG. 3B is a plan view of the first embodiment of a conveyor module according to the invention.

FIGS. 3A and 3B show a first embodiment of a conveyor module which achieves the objects of the invention.

Conveyor module 100 comprises a substantially closed conveyor housing 110, made up of, among other panels, side plates 111 and table surface 115. Table surface 115 is mounted to side plates 111 by using quick disconnect members 116, for reasons to be described below. Conveyor module 100 is supported by legs 150. The interior of conveyor housing 110 defines vacuum chamber 170. Vacuum chamber 170 is evacuated by using first hose 165 attached to the vacuum end of blower 160. The vacuum in vacuum chamber 170 causes a negative pressure to occur on table surface 115 because of the presence of vacuum holes 175. Hose 167 provides vacuum to article supply feeder 400.

To feed blanks in direction F, conveyor module 100 preferably has two parallel side-by-side conveyor belts 120. On the outsides and between the parallel side-by-side conveyor belts 120 are the vacuum holes 175, which attract blanks B to belts 120. Conveyor belts 120 are supported by conveyor table 115 across their entire length and, therefore, do not flex as with prior art vacuum conveyors such as shown in U.S. Pat. No. 4,614,512, to Capdeboscq. While U.S. Pat. No. 5,094,658, to Smithe et al. shows a similar conveyor table to that of the instant invention, they do not disclose the use of such a conveyor table with paper-board articles; Smithe et al. are concerned with paper envelopes, which pose entirely different feed problems from paper-board articles.

Each conveyor belt 120 is fed around its own fixed idler rollers 125, 126, sliding idler roller 130, and drive roller 127. Idler rollers 125 are mounted in unshaped grooves 122 by use of axle pins 128. Drive roller 127 is driven by motor 128 which is of the type that can be easily synchronized with other motors for reasons described below. It is envisioned that typically a servomotor will be used. By adjusting the lateral position of roller 130, by use of, for example, a fluidic cylinder, it is possible to adjust the tension of belts 120. Replacing belts 120 is effectuated as follows: the vacuum is disengaged, sliding idler rollers 130 are slid away from belt 120 and drive roller 122; table surface 115 is removed quickly by use of quick disconnect members 116; idler rollers 125 are removed from slots 122; old belts 120 are removed; the new belts added; and the conveyor module 100 is put back together. It can easily be seen that this process is much simpler than that discussed with reference to the prior art, i.e., minutes with the instant invention rather than the almost two days it took takes to replace the belts of prior art folder/gluers.

Belts 120 of the instant invention last substantially longer than those of the prior art because many less rollers are in contact with belts 120. While it was discussed with reference to FIG. 2A that hundreds of rollers may be in contact with prior art belts, with reference to the instant invention there may be less than ten. Furthermore, as all the rollers (except for pivoting idler roller 130) are rigidly mounted and do not float as in the prior art, their assemblies are not subject to rapid failure as described with respect to the prior art. The fact that with the instant invention belts 120 are never nipped between opposing rollers also greatly reduces belt fatigue.

Mounted to, and generally above, conveyor housing 110, are conventional folding elements 200, which are preferred to comprise conventional stationary plates and bars that manipulate blank panels. While these folding elements, per se, may be known, to date they have never been used with a simple device like the vacuum conveyor described above. They have been parts of complex machines such as that shown in FIG. 2. It is also possible that the folding elements may comprise independently operated movable folding elements, such as folding belts. It becomes self-evident that because there are no overhead blank conveying components present, it is possible to modify folding elements 200 such that 180° folds may be made. Furthermore, the number of overall components and moving parts are greatly reduced, thereby minimizing adjustment and repair downtimes from those of prior art folder/gluers.

Also mounted to, and generally above, conveyor housing 110 is glue applicator 300 for placing glue on various panels of the blank. Preferably, glue applicator 300 comprises a single glue gun. However, it is possible that glue applicator 300 may comprise pairs of conventional glue guns for placing glue on various panels of the blank. Pairs of glue guns may be used because conveyor module 100 is capable of feeding, folding, and forming over 200,000 articles per hour. This is well beyond the cycling range of a single typical solenoid-activated glue gun. Accordingly, per gluing zone, a pair of conventional solenoid activated glue guns could be used. Each glue gun of each pair alternates with the other glue gun of that pair in squirting glue onto a passing blank. This use of alternating glue guns makes it possible to keep the line moving at the 200,000 article per hour rate.

Figure 4A:
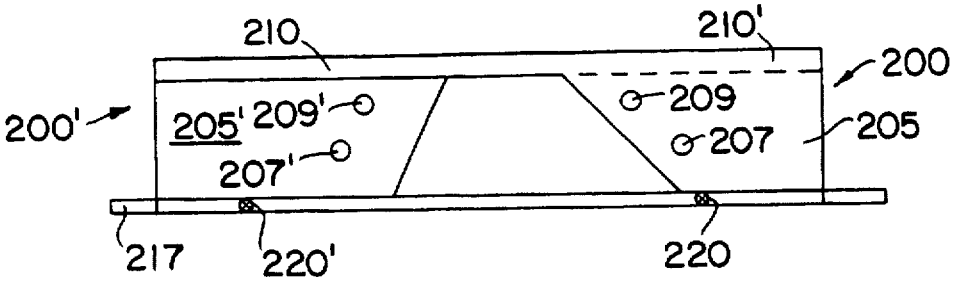
FIG. 4A is an elevation view showing a second embodiment of a conveyor module according to the invention.
Figure 4B:
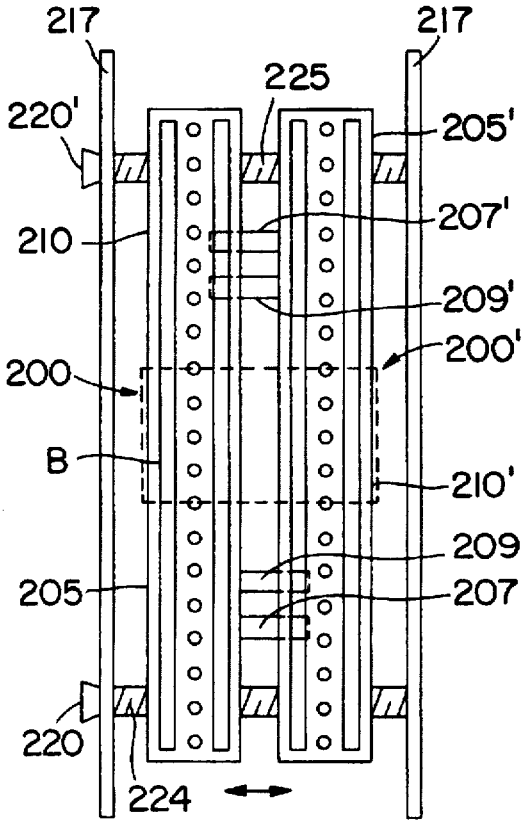
FIG. 4B is a plan view showing a second embodiment of a conveyor module according to the invention.
Figure 4C:
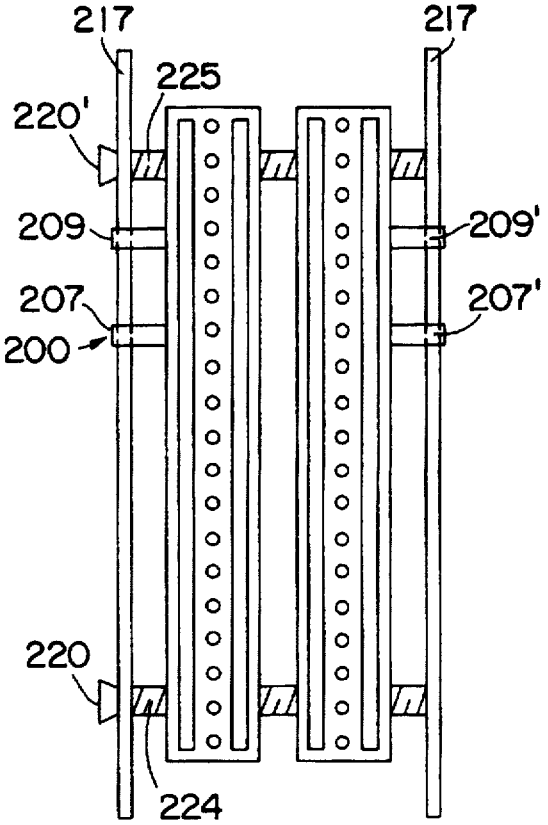
FIG. 4C is a plan view showing a third embodiment of a conveyor module according to the invention.

It is highly advantageous to be able to place multiple modules in lateral arrangement and close proximity to one another. Because box blanks come in various sizes, blank feeding devices should be able to feed blanks of various sizes. Accordingly, as shown in FIGS. 4A and 4B, by making conveyor housings 200, 200' have diving board-like configurations, in which each module has a support portion 205, 205 and an overhanging portion 210, 210', two modules may be placed very close to each other to allow the two modules to jointly feed wide blank B. As shown in FIGS. 4A and 4B, protruding drive motors 209, 209' and blower motors 207, 207' each neatly fit under overhanging portion 210, 210' of the other conveyor. Drive motors 209, 209' can be then driven in synch in any known manner, for example, by having them both be servomotors attached to a common controller (not shown) . To allow for varying the distance between conveyors 200 and 200', each handcrank 220, 220' has its own jackscrew 224, 225 mounted to rails 217 and passing through a threaded bearing in one of conveyors 200, 200' and a non-threaded bearing in the other of conveyor 200, 200'. Thus, each crank 220, 220' controls the lateral position of one of conveyors 200, 200'. By turning each crank 220, 220', the relative positions of the two conveyors 200, 200' can be varied. In addition to using this diving-board configuration, it is also possible to have the conveyors 200, 200' be rectangular and come in left-handed and right-handed configurations, as shown in FIG. 4C. With that configuration, it is also possible to place two conveyor modules close together.

Figure 1:
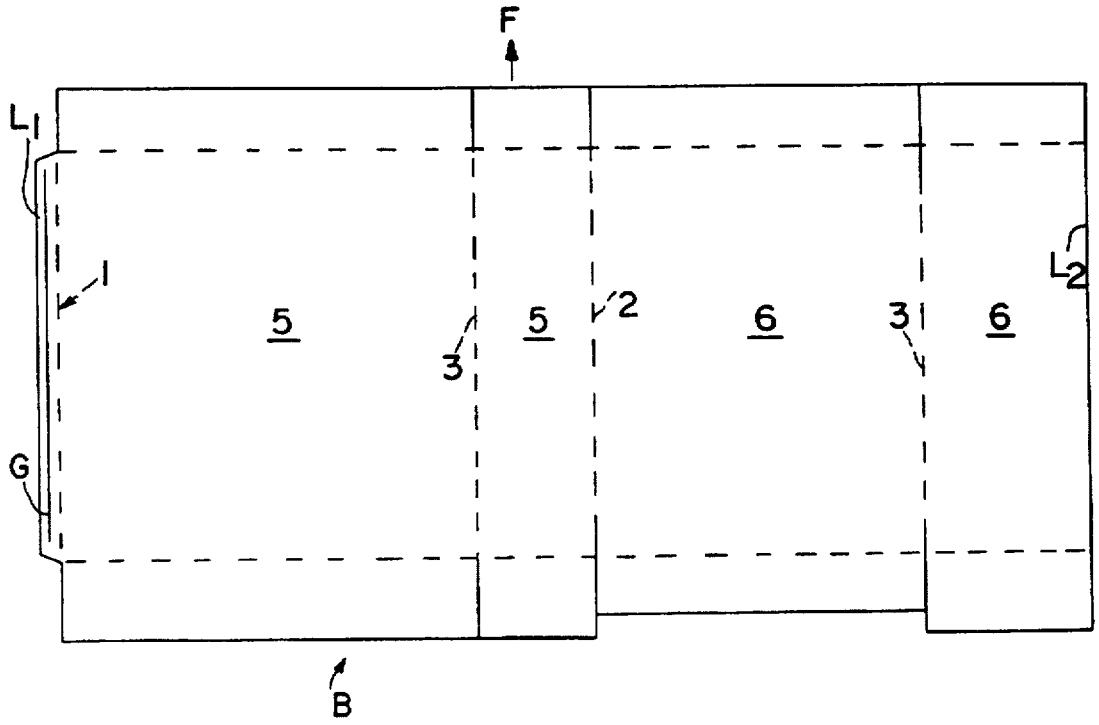
FIG.1 PRIOR ART
FIG. 1 is plan view of a conventional carton blank that can be folded into a carton.
Figure 2A:
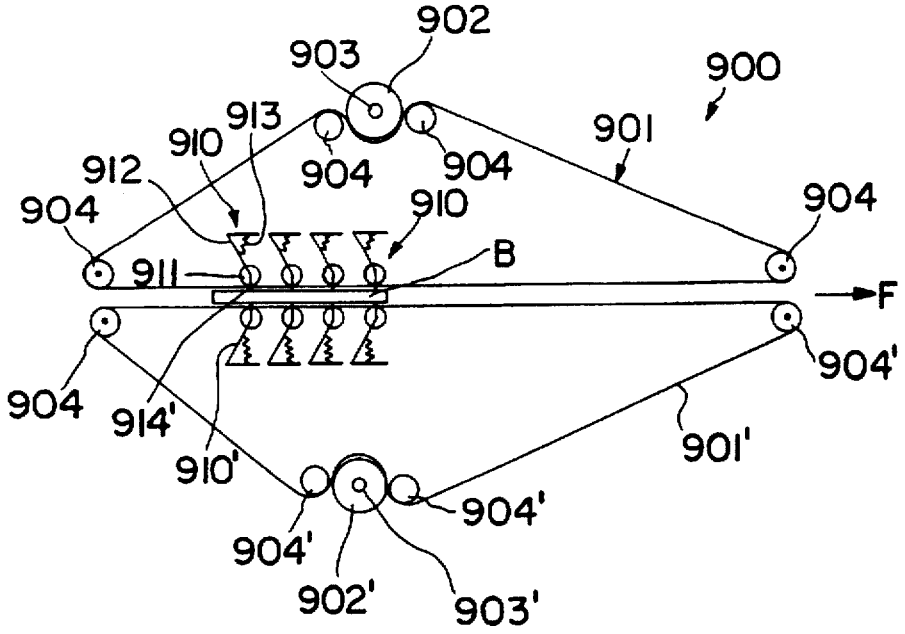
FIG. 2A PRIOR ART
FIG. 2A is an elevational view of a conventional carton blank feeder used in conventional folding and box making devices.
Figure 2B:
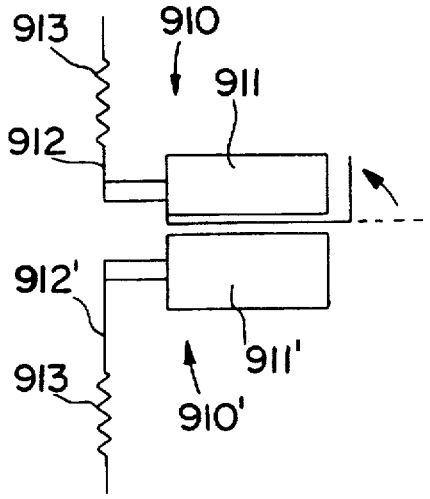
FIG. 2B PRIOR ART
FIG. 2B is a highly simplified elevational view showing a flaw in conventional folding and box making devices.
Figure 5A:
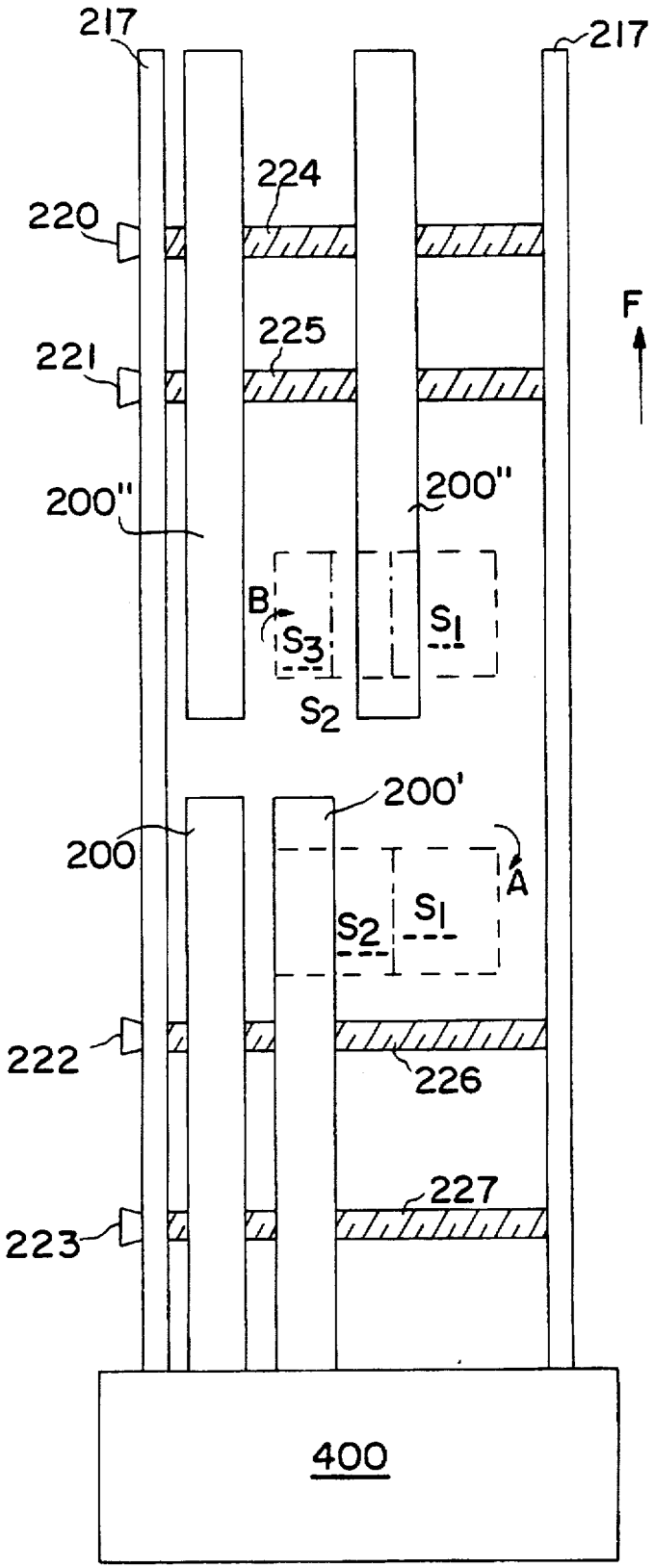
FIGS. 5A–B are simplified plan views showing multiple conveyor modules placed in a staggered configuration.
Figure 5B:
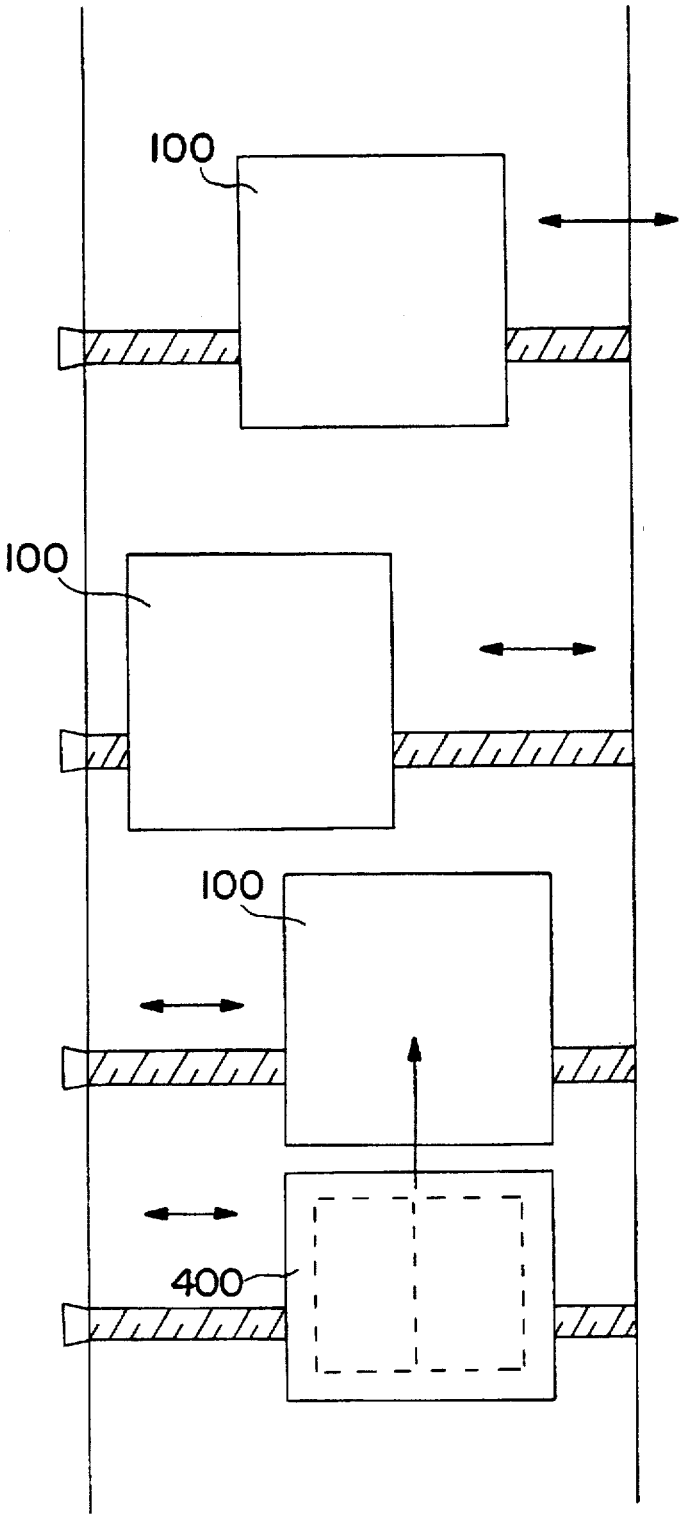

It is also highly advantageous to be able to place conveyor modules both next to each other and in-line, so conveyors can be staggered allowing for some panels to be contacted by vacuum while other panels are manipulated, e.g., folded. For example, with the blank of FIG. 1, while folds 1 and 2 are made, panels 5, 5' are contacted by vacuum. However, while folds 3, 3 are made, panels 6, 6' are contacted by vacuum. This is achieved by the conveyor arrangement shown in FIG. 5A, which uses staggered belts, and in which the various motors and folding elements have been omitted for easier viewing. In FIG. 5A, in between rails 217 are four conveyors 200, 200', 200", and 200'". Any number of conveyors, however, can be placed in line with others; it all depends on the number and complexity of the required folds. Each conveyor 200, 200', 200", 200'" has its own handcrank 220–223 attached to jackscrew 224–227, respectively, for adjusting the lateral position of each conveyor. In the arrangement shown in FIG. 7, at point A, the left-most part of the blank is held by the conveyor 200', while the blank is folded into segments $S_1$ and $S_2$. Because conveyors 200 and 200" are not used, their handcranks are turned so as to move these conveyors out of the way. At point B, segment $S_1$ and part of segment $S_2$ are held by conveyor 200" while the segment $S_2$ is folded into segments $S_2$ and $S_3$ by the not shown folding elements. In prior art devices, such as shown in FIGS. 2A and 2B, due to the large number of overhead belts, etc., it becomes self evident how complex such an arrangement would be as compared to the invention disclosed herein. Finally, while the use of side-by-side conveyor modules is preferred, it is entirely possible to use a line of single, but wider, laterally movable conveyor modules 100 (FIG. 5B).

Figure 6A:
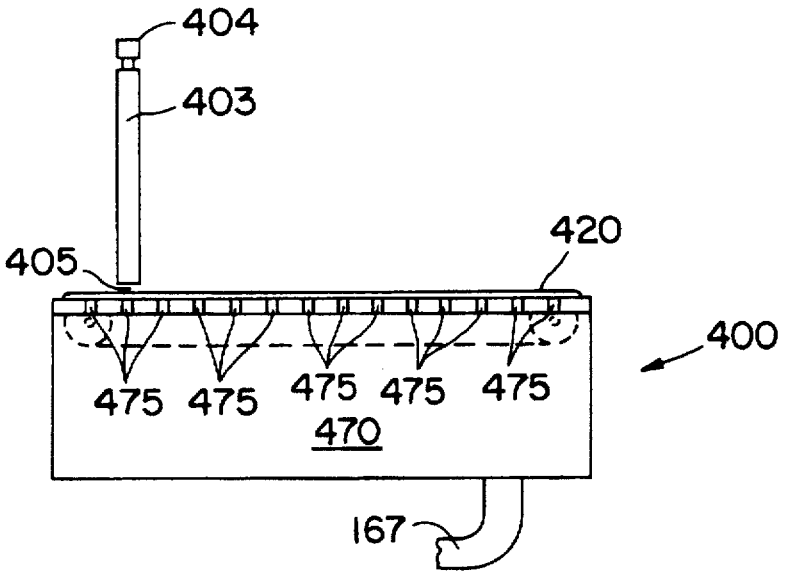
FIGS. 6A–C are different views of an article feed supply for use with the folder/gluer according to the invention.
Figure 6B:
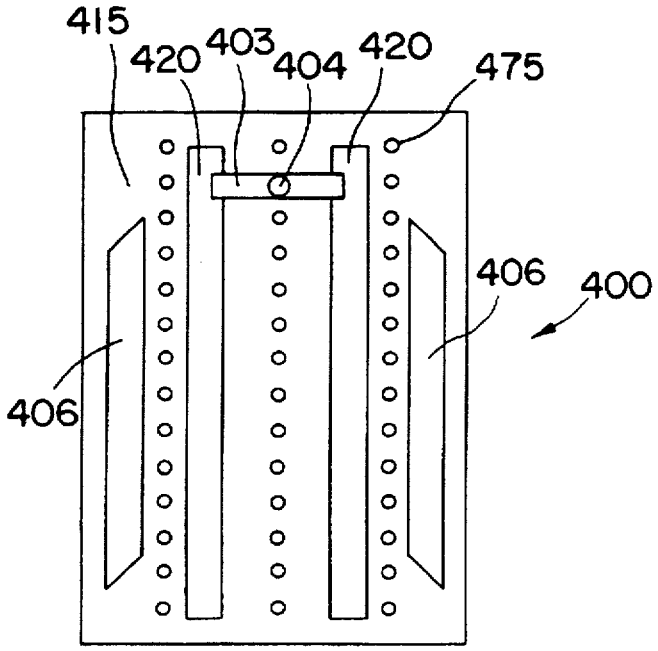
Figure 6C:
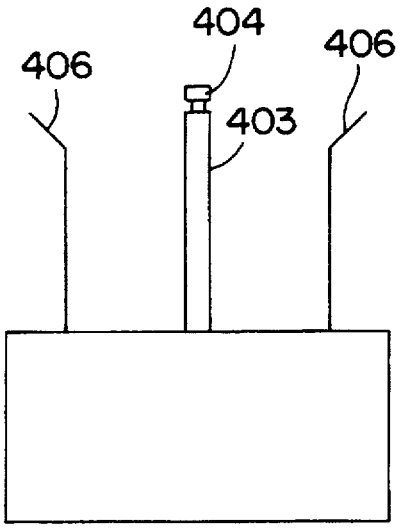

Article (blank) supply feeder 400 will now be described. Article supply feeder 400 is similar in operation to conveyor module 100. As shown in FIGS. 6A–C, article supply feeder 400 has a table surface 415 containing vacuum holes 475 therein. Conveyor belts 420 span the entire table surface 415. As previously described, hose 167 supplies vacuum to vacuum chamber 470 for holding an article against belts 420. Adjustable side registration guides 406 assure the stack of articles contained in feeder 400 is side squared. Finally, gate 403 front registers the stack of articles in feeder 400 and, by use of nip 405, assures that only one article at-a-time is fed out of feeder 400. Screw 404 adjusts the size of nip 405. By having vacuum holes 475 and belts 420 span both sides of gate 403, the article being fed out of feeder 400 is kept almost perfectly flat against belts 420, assuring that the bottom of gate 403, in the area of nip 405, does not damage the outgoing article. This structure provides for much more reliable separation and feeding than with the prior art.

The above description is given in reference to a conveyor module having a vacuum hold-down used with a folding machine. However, it is understood that many variations are apparent to one of ordinary skill in the art from a reading of the above specification and such variations are within the spirit and scope of the instant invention as defined by the following appended claims.

That which is claimed:

1. A modular vacuum hold down device for a folding mechanism for pre-scored paper-board articles, including a first vacuum hold down device comprising:

a substantially enclosed, free-standing, rectangular-shaped conveyor housing having legs such that said housing may be relocated without regard as to any other machinery, a vacuum inlet, side plates, a conveyor table having vacuum holes along its length, and defining a vacuum chamber therein;

at least one conveyor belt in between said side plates and spanning said conveyor table such that said at least one conveyor belt cannot flex;

a drive mechanism associated with said at least one conveyor belt for driving said at least one conveyor belt;

a vacuum source comprising a blower driven by a motor, said vacuum source in fluid communication with said vacuum inlet, whereby when said vacuum source is activated, a vacuum is created in said vacuum chamber and in an area of said conveyor table having said vacuum holes, thereby causing said pre-scored paper-board articles to adhere to said at least one conveyor belt and against said conveyor table;

said blower motor and said drive mechanism mounted to one of a left side and a right side of an outside of said conveyor housing to form one of a left-handed version and a right-handed version, respectively; and folding elements spaced above said conveyor housing for folding and forming a flat pre-scored paper-board article fed from an article feeder, said folding elements independently movable with respect to said modular vacuum hold down device to form said article into a container.

2. The device according to claim 1, further comprising:

quick-disconnect members for securing said conveyor table to said side plates;

first and second end pulleys for supporting said at least one conveyor belt, said first and second end pulleys having first and second axle pins, respectively; and U-shaped grooves in said side plates for receiving said first and second axle pins, said grooves being angled relative to horizontal.

3. The device according to claim 1, wherein said folding elements comprise stationary folding plates and bars.

4. The device according to claim 1, wherein said drive mechanism comprises a series of fixed idler rollers, a sliding idler roller, a driven roller, and a motor operatively associated with said driven roller, whereby said sliding idler roller varies the degree of wrap of said at least one conveyor belt around said driven roller.

5. The device according to claim 1, further comprising:

a second vacuum hold down device for a folding mechanism substantially similar to the first vacuum hold down device for a folding mechanism;

wherein said blower motor and drive mechanism of said first hold down device are mounted on the left side of the outside of said first conveyor housing, and said blower motor and drive mechanism of said second conveyor housing are mounted on the right side of the outside of said second conveyor housing; whereby said first and second hold down devices can be placed close together in a parallel configuration.

6. The device according to claim 5, wherein said drive mechanisms include servomotors connected to a common controller whereby said at least one conveyor belt of each hold down device can be operated in synchronism to simultaneously move a larger pre-scored paper-board article.

7. The device according to claim 6, further comprising:

two parallel rails securable to a floor adjacent where said first and second hold down devices are to be positioned, one rail placed on each outer facing side of said first and second hold down devices;

two threaded screws attached between said rails for rotatable motion, each of said threaded screws passing through a threaded bearing in one of said hold down devices and a non-threaded bearing in the other of said hold down devices;

whereby turning each of said threaded screws varies the lateral positions of each of said hold down devices.

8. The device according to claim 1, further comprising an article feed supply for feeding articles to said first vacuum hold down device comprising:

a substantially enclosed housing having a vacuum inlet, side plates, a conveyor table having vacuum holes along its length, and defining a vacuum chamber therein;

at least one conveyor belt in between said side plates and spanning said conveyor table such that said at least one conveyor belt cannot flex;

a drive mechanism associated with said at least one conveyor belt for driving said at least one conveyor belt;

a vacuum source in fluid communication with said vacuum inlet, whereby when said vacuum source is activated, a vacuum is created in said vacuum chamber and in an area of said conveyor table having said vacuum holes, thereby causing said pre-scored paper-board articles to adhere to said at least one conveyor belt and against said conveyor table; and a front registration gate, said at least one conveyor belt and said registration gate having a nip therebetween, said at least one conveyor belt and said vacuum holes spanning both sides of said registration gate.

9. The device according to claim 1, wherein:

said conveyor housing is shaped like a diving board, and has a body portion and an overhanging horizontal portion.

10. The device according to claim 9, further comprising:

a second vacuum hold-down device for a folding mechanism substantially similar to the first vacuum hold-down device for a folding mechanism;

wherein said blower motor and said drive mechanism of said first hold down device fit under the overhanging portion of said second hold down device, and said blower motor and said drive mechanism of said second hold down device fit under the overhanging portion of said first hold down device; whereby said first and second hold down devices can be placed close together in a parallel configuration.

11. The device according to claim 10, wherein said drive mechanisms include servomotors connected to a common controller whereby said at least one conveyor belt of each hold down device can be operated in synchronism to simultaneously move a larger pre-scored paper-board article.

12. The device according to claim 11, further comprising:

two parallel rails securable to a floor adjacent where said first and second hold down devices are to be positioned, one rail placed on each outer facing side of said first and second hold down devices;

two threaded screws attached between said rails for rotatable motion, each of said threaded screw passing through a threaded bearing in one of said hold down devices and a non-threaded bearing in the other of said hold down devices;

whereby turning each of said threaded screws varies the lateral positions of each of said hold down devices.

* * * * *

UNITED STATES PATENT AND TRADEMARK OFFICE

CERTIFICATE OF CORRECTION

PATENT NO. : 5,797,831

DATED : August 25, 1998

INVENTOR(S) : John T. Roberts and Jimmy R. Bridges

It is certified that error appears in the above-identified patent and that said Letters Patent is hereby corrected as shown below:

On the title page, item [73]

Assignee's name to read "Roberts Systems, Inc.", instead of "Roverts Systems, Inc."

Signed and Sealed this

Fifteenth Day of December, 1998

*Attest:*

*Attesting Officer*

BRUCE LEHMAN

*Commissioner of Patents and Trademarks*